United States Patent [19]

Pap et al.

[11] 4,293,162

[45] Oct. 6, 1981

[54] SUN SHADE FOR INFANT SEAT AND THE LIKE

[76] Inventors: Joe P. Pap; Marilyn D. Pap, both of 19742 Trident La., Huntington Beach, Calif. 92646; Arvil L. Beyler; Doris M. Beyler, both of 10331 Calle Independencia, Fountain Valley, Calif. 92708

[21] Appl. No.: 130,750

[22] Filed: Mar. 17, 1980

[51] Int. Cl.[3] ..... A47C 7/62

[52] U.S. Cl. ..... 297/184; 135/5 R

[58] Field of Search ..... 297/184; 135/5 R, 7, 135/16

[56] References Cited

U.S. PATENT DOCUMENTS

| | | | |
|---|---|---|---|
| 890,921 | 6/1908 | Perkins | 135/7 |
| 3,243,230 | 3/1966 | Otto | 135/5 R |
| 3,258,291 | 6/1966 | Ezquerra | 297/184 X |
| 3,879,086 | 4/1975 | Moceri | 297/184 |
| 4,100,633 | 7/1978 | Pintos | 297/184 X |

FOREIGN PATENT DOCUMENTS

| | | | |
|---|---|---|---|
| 290058 | 1/1968 | Australia | 297/184 |
| 2322565 | 4/1977 | France | 297/184 |

*Primary Examiner*—James T. McCall

*Attorney, Agent, or Firm*—Francis X. LoJacono

[57] ABSTRACT

A sun shade for an infant seat wherein the sun shade includes a canopy that is adjustable vertically, horizontally and angularly with respect to the associated seat, the canopy having an adjustable arm-and-leg member, one end of the arm member being connected to the canopy frame structure by means of a universal socket bracket, and the opposite end thereof being adjustably attached to the leg member, the leg member being slidably adjustable within a support bracket attached to the seat, whereby the infant positioned within the seat can be shaded, whether the seat is placed in a seating position or in a lying position.

4 Claims, 8 Drawing Figures

SUN SHADE FOR INFANT SEAT AND THE LIKE

BACKGROUND OF THE INVENTION

1. Field of the Invention

This invention relates to a sun shade, and more particularly to a sun shade for an infant seat that is capable of being multi-angularly adjustable.

2. Description of the Prior Art

As is well known in the art, various problems and difficulties have been encountered in providing suitable sun-shade devices for protecting infants when exposed to the sun, particularly when a baby is placed in a singular-structured-type seat designed for use in a motor vehicle.

Several types of visor, parasol and hood devices have been tried. However, these devices have features that restrict their use; and they are generally complicated to operate or are limited in their adjusting features.

In U.S. Pat. No. 3,224,806, the type of canopy shown is limited in its positioning with respect to the chair with which it is associated; and it is specifically adapted as a combination table and chair for infants to be used indoors or outdoors. This device, however, can not be readily carried on top of a front or rear seat of a moving vehicle. Like most canopies, it is limited to an up or down folding position.

Canopies used and associated with baby carriages, such as illustrated in U.S. Pat. No. 4,072,345, are also restricted in their operation and design.

Thus, with the advancement in design of infant seat units, such as the modular-constructed bucket-type seat where a baby can be seated upright or be laid in a horizontal position, a more universally adjustable type of sun-shade canopy is needed.

SUMMARY AND OBJECTS OF THE INVENTION

The present invention has for an important object to provide a sun-shade device that is particularly designed for a single modular-constructed infant seat, whereby the sun shade provides a canopy that is capable of being vertically, horizontally and/or angularly positioned so as to protect the baby from the sun, regardless of the direction of the rays of the sun.

It is another object of the invention to provide a sun shade that can be readily mounted to an infant car seat, whereby the combination of both can be readily received within a vehicle.

It is still another object of the invention to provide a sun-shade device of this character that is easily adjustable within a confined space, such as the front seat of a vehicle, yet requires a minimum of operating parts.

A still further object of the invention is to provide a sun-shade device of this character that is relatively inexpensive to manufacture, and is simple and rugged in construction.

The characteristics and advantages of the invention are further sufficiently referred to in connection with the accompanying drawings, which represent one embodiment. After considering this example, skilled persons will understand that variations may be made without departing from the principles disclosed; and we contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
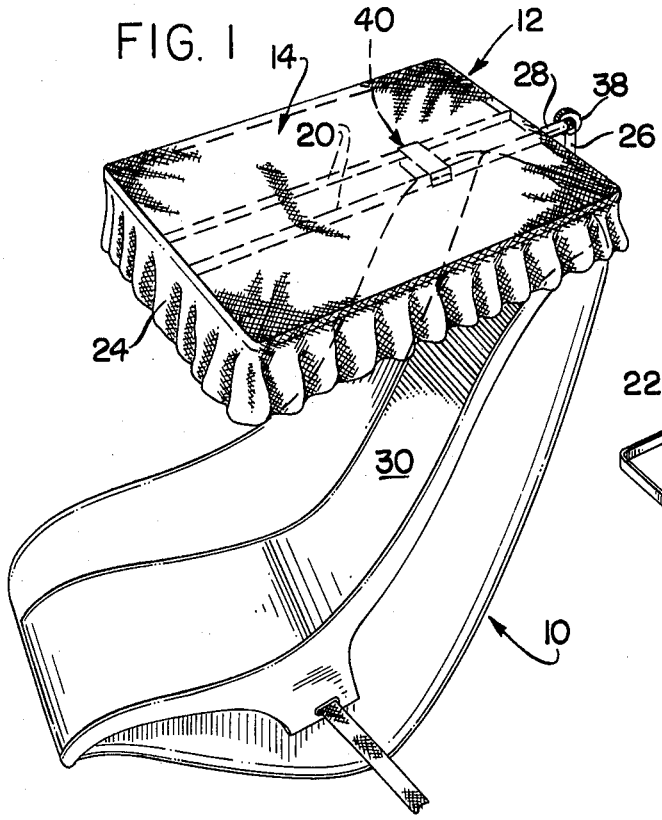
FIG. 1 is a pictorial view of the present sun-shade device mounted to a modular-type infant seat adapted for use within a vehicle.
Figure 2:
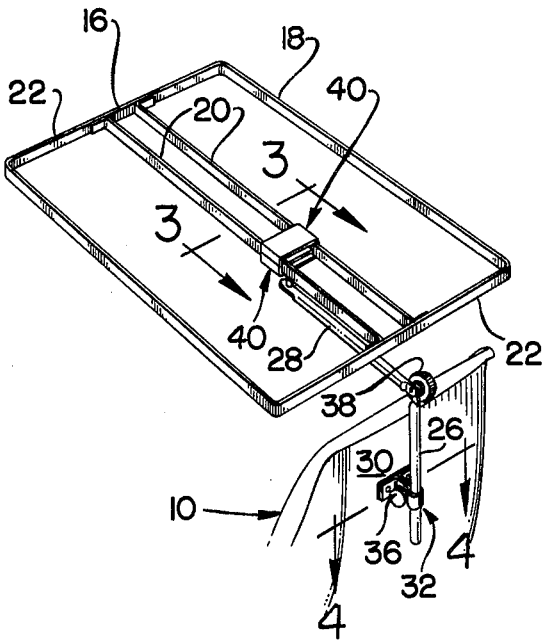
FIG. 2 is a perspective view of the sun shade with the canopy cover removed to show the frame structure thereof and how it is mounted to the seat.

Referring more particularly to FIG. 1, there is shown an infant seat, indicated generally at 10. This type of infant seat is designed to be adjustable in an upright position or a horizontal position, or any angular position therebetween. Infant seat 10 is also readily adaptable for use within a vehicle.

However, this particular-type of infant seat has heretofore lacked a multi-positionable sun shade, which is generally designated at 12. Due to the versatility of seat 10, a sun shade must be capable of being positioned in various arrangements to protect the infant from the rays of the sun, whether he is sitting up or lying down. This is accomplished by providing a sun shade that comprises a canopy 14 having a frame structure 16 which is formed by a peripheral frame member 18, preferably formed from a continuous metal strip, and including a pair of parallel longitudinally arranged strut members 20 defining rails which are affixed to oppositely disposed end members 22 of frame 18. Strut members 20 can be secured in any suitable manner, such as spot welding and the like. Thus, the frame structure 16 is shown in FIG. 1 as having a canopy cover 24 positioned thereover. As can be well understood, canopy cover 24 may be readily removable for cleaning and can be made from any suitable material or fabric, as desired.

Accordingly, frame 16 is adjustably mounted to seat 10 by a multi-adjustable support structure which comprises a leg member or bar 26, and an extended arm member 28 attached to the leg member so as to rotate about the connecting axis therebetween. That is, leg 26 is mounted to the back member 30 of seat 10 in a somewhat parallel relationship thereto by means of bracket 32. Various brackets can be employed; however, the bracket therein shown comprises a pair of finger members 34 defining a clamp, each finger being secured to the back 30 of seat 10 by screws or bolts 35, and the fingers 34 being held in a clamping position by thread knob 36. Thus, it can be seen that leg 26 can be adjusted longitudinally along its length to raise or lower canopy 14. The upper end of leg 26 is adapted to attach to arm 28 by means of threaded knob 38, which allows arm 28 to be positioned at various selective angles relative to leg 26.

Movably connected to the opposite free end of arm 28 is a linear-adjusting means, designated at 40, which is slidably mounted to strut members 20, whereby the frame structure 16 can be readily moved longitudinally therein. That is, the frame can be extended either forwardly or rearwardly of the seat. In addition, the linear-adjusting means is interconnected to the free end of arm 28 by a universal connecting means, indicated generally at 42, which is formed as part of the linear-adjusting means 40.

Figure 3:
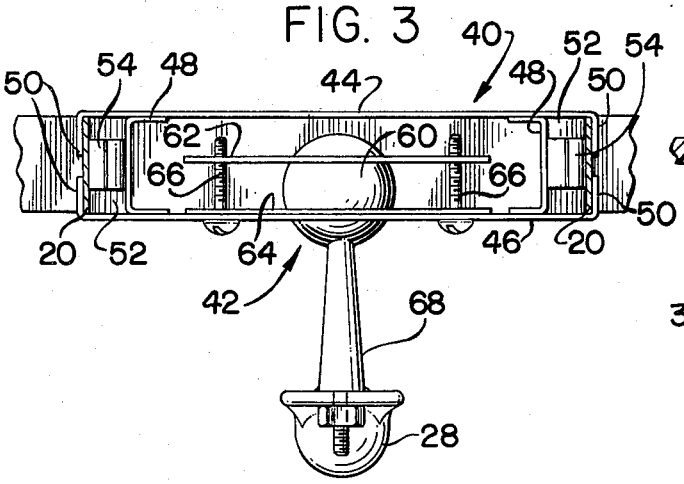
FIG. 3 is an enlarged cross-sectional view taken substantially along line 3—3 of FIG. 2, showing the universal mounting bracket slidably supported on the frame structure.
Figure 4:
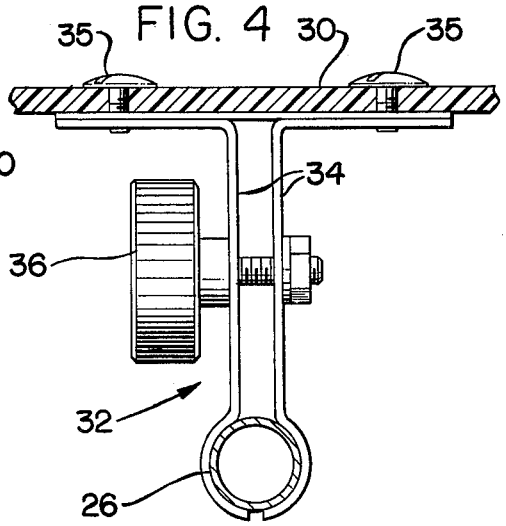
FIG. 4 is an enlarged cross-sectional view taken substantially along line 4—4 of FIG. 2, showing the adjustable bracket secured to the back of the infant seat.

Linear-adjusting means 40, as seen in FIG. 3, comprises a housing defined by an upper plate 44 and a lower plate 46 connected by support members or ribs 48, the ribs 48 being positioned adjacent the free ends of plates 44 and 46, and the free ends being bent inwardly to form flanges 50. A channel 52 is formed between ribs 48 and flanges 40, wherein strut members 20 are slidably received to allow linear movement therebetween. Included in each channel is a restraining means which permits selective movement of the canopy, the restraining means in this arrangement comprising leaf springs 54 affixed to ribs 48 and pressed against struts 20.

Figure 5:
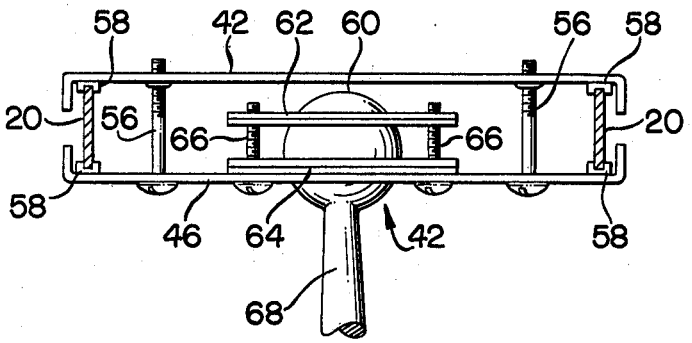
FIG. 5 is a cross-sectional view similar to that of FIG. 3, showing an alternative arrangement of the linear-adjusting means.
Figure 6:
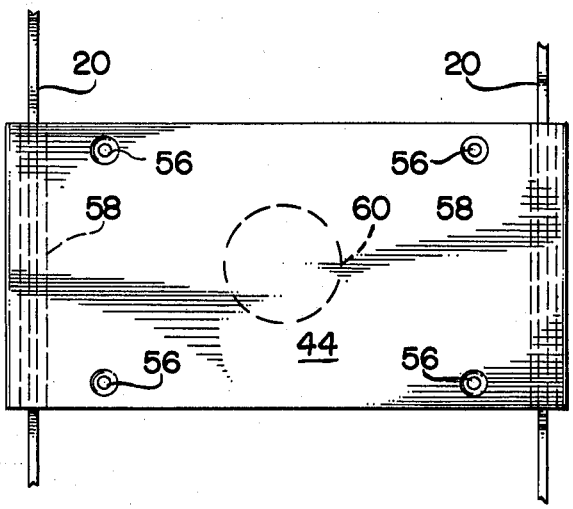
FIG. 6 is a top-plan view of the linear-adjusting means shown in FIG. 5.

However, an alternative arrangement is illustrated in FIGS. 5 and 6, wherein plates 44 and 46 are connected by support members defined by pins 56, and wherein the restraining means comprises a plurality of guide members 58 formed from a nylon bar member having a longitudinal channel to receive struts 20. This also allows for the selective positioning of the canopy relative to the seat.

The universal connecting means is provided in both arrangements of the linear-adjusting means; and it comprises a ball-joint member 60 clamped to lower plate 46 by tension-adjusting means defined by upper and lower keeper plates 62 and 64, respectively, connected by tension screws 66. Ball member 60 is provided with a support base 68 which is secured to the free end of arm 28.

Figure 7:
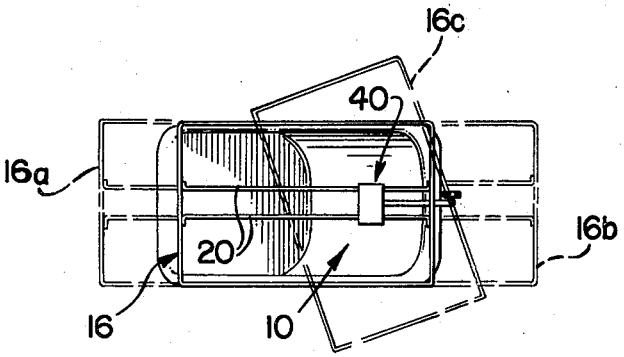
FIG. 7 is a top-plan view of the canopy-frame structure shown in various adjustable positions relative to the seat.
Figure 8:
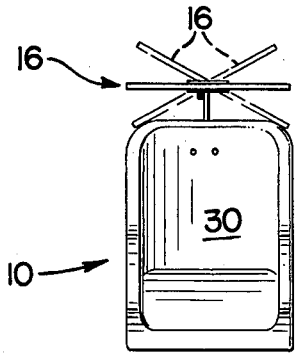
FIG. 8 is a front view of the seat, showing in phantom lines the canopy-frame structure in a horizontal and in various angular positions.

Thus, it can be seen in FIGS. 7 and 8 that canopy 14 can be arranged and positioned in many variations. In FIG. 7, the canopy-frame structure 16 is shown adjusted to a forwardly extended position 16*a;* a rearwardly extended position 16*b;* and an angularly rotated position 16*c*. Canopy 14 can be rotated 360° about ball joint 60 and can be tilted in many directions, such as seen in FIG. 8.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and we do not wish to be restricted to the specific form shown or uses mentioned, except as defined in the accompanying claims.

We claim:

1. A sun-shade device for infant seats and the like defining a canopy that is adjustable vertically, horizontally and angularly, wherein the device comprises:

a frame structure having a peripheral frame member, including a pair of parallel longitudinal strut members;

a canopy cover adapted to be removably supported by said frame structure;

a linear-adjusting means slidably mounted to said strut member, whereby said frame structure may be adjusted longitudinally along said strut members, wherein said linear-adjusting means comprises:

a housing having an upper plate and a lower plate secured together by support members; and restraining means mounted in said housing and adapted to slidably receive said strut members for longitudinal movement therein;

a universal connecting means mounted to said linear adjusting means to allow said canopy to be arranged at a selected angular position; and a multi-adjustable support structure attached between said universal connecting means and said seat.

2. A sun-shade device as recited in claim 1, wherein said restraining means comprises a plurality of guide members attached to said plates, and positioned to engage said strut members to control the longitudinal movement of said frame structure.

3. A sun-shade device as recited in claim 1, wherein said restraining means comprises a spring member mounted to said support member of said housing, and arranged to engage said strut members to control the longitudinal movement of said frame structure.

4. A sun-shade device as recited in claim 1, wherein said universal connecting means comprises a ball-joint member having a support base, said ball-joint member being adjustably mounted to said lower plate of said housing and said support base being secured to said arm member.

* * * * *